US005159782A

United States Patent [19]

Sales

[11] Patent Number: 5,159,782

[45] Date of Patent: Nov. 3, 1992

[54] RETAINER FOR PRE-HUNG DOOR

[76] Inventor: Charles R. Sales, 4243 Springrock Cir., West Linn, Oreg. 97068

[21] Appl. No.: 820,340

[22] Filed: Jan. 14, 1992

[51] Int. Cl.[5] ..... E06B 1/00

[52] U.S. Cl. ..... 49/380; 206/325

[58] Field of Search ..... 49/380, 503, 504; 206/321, 325

[56] References Cited

U.S. PATENT DOCUMENTS

| | | | |
|---|---|---|---|
| D. 319,007 | 8/1991 | Rogers et al. | D8/400 |
| 2,706,837 | 4/1952 | Jackson | 206/325 X |
| 2,720,308 | 10/1955 | Howell | 206/325 |
| 2,728,956 | 1/1956 | Jackson | 49/380 |
| 2,730,773 | 1/1956 | Logue | 49/380 |
| 3,593,458 | 7/1971 | Wahlfeld | 206/325 X |
| 4,151,681 | 5/1979 | Roberts | 49/501 X |

*Primary Examiner*—Renee S. Luebke
*Assistant Examiner*—Jerry Redman
*Attorney, Agent, or Firm*—Robert L. Harrington

[57] ABSTRACT

A retainer for securing and retaining a pre-hung door unit in a closed position relative to a door jamb. The retainer includes a shaped cylindrical plug configured to fit closely in the edge bore of the door. The plug is insertable into the edge bore through the face bore of the door and has lobes extending transversely to limit its entry into the edge bore. The placement of the transverse lobes maximizes the length of the plug extending from the lobes which enables an end of the plug to extend beyond the door edge into a bore in the strike jamb of the door jamb when the door is closed relative to the door jamb. A bolt extended through the back of the strike jamb and engaging the plug secures the plug in position and secures the door in a closed position relative to the door jamb. The bolt may be tightened adequately to clamp the strike jamb to the door edge. The bolt and the plug are provided with double lead blunt end threads for rapid assembly and disassembly. The plug has relieved sides for ease of moving the plug within the edge bore of the door which is a benefit for installing the plug and also is an aid to a door installer. A cinch ring provided on the plug near the extended lobes prevents lateral movement of the plug in the edge bore. The configuration of the plug accommodates both circular and rectangular bores that are normally provided in the strike jamb of the door jamb.

9 Claims, 2 Drawing Sheets

FIG. 1
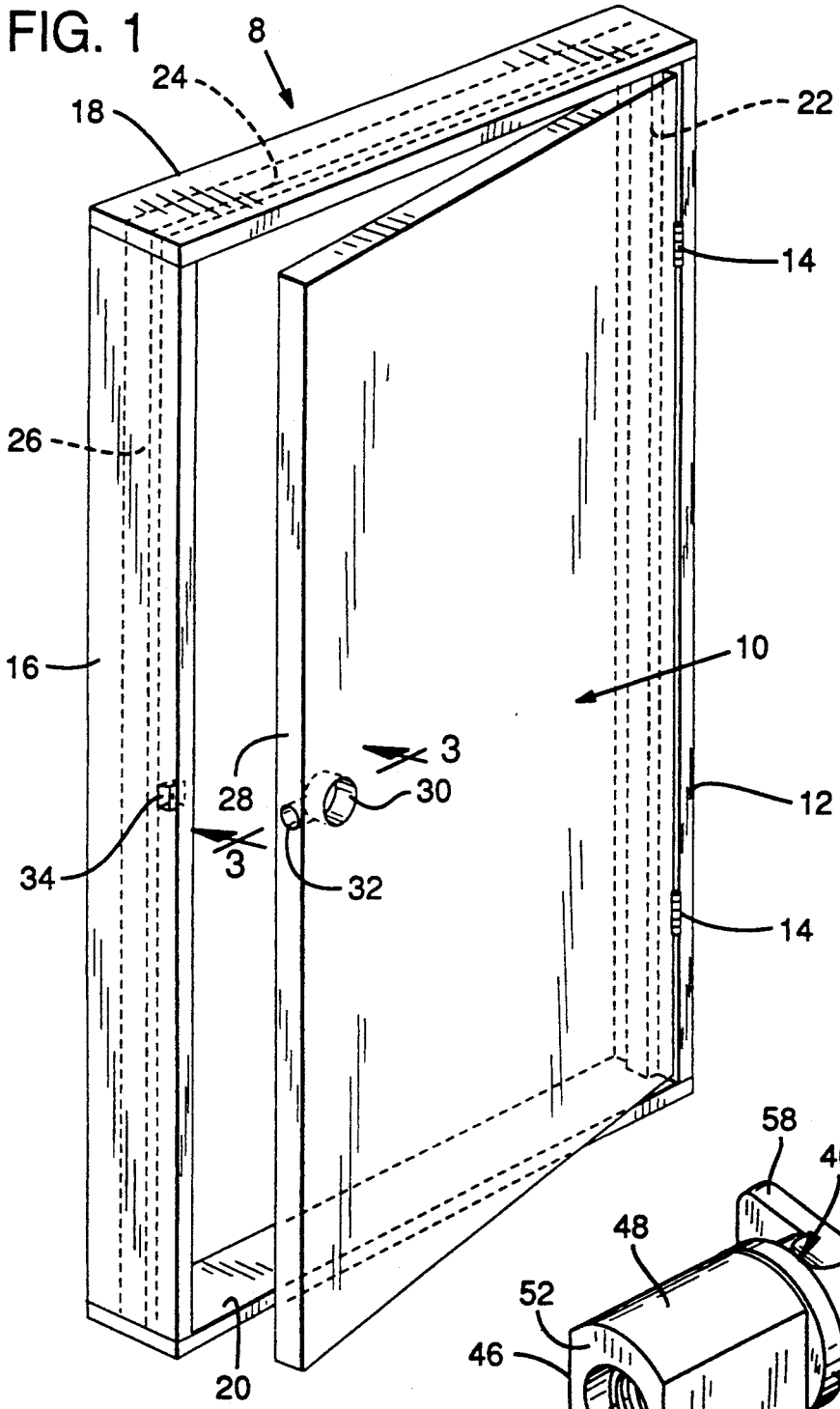
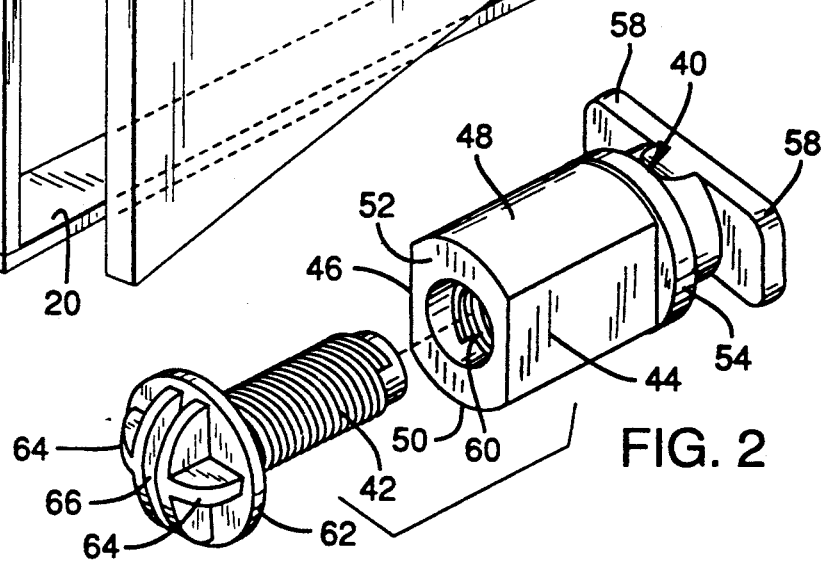
FIG. 2

RETAINER FOR PRE-HUNG DOOR

BACKGROUND INFORMATION

1. Field of the Invention

This invention relates to doors pre-hung on door frames and in particular it relates to a door retainer for maintaining a door in closed position relative to the door frame.

2. Background of the Invention

Pre-hung door shops and certain manufacturers supply doors pre-hung on door jambs. The door jambs include two vertical side jambs which will be referred to as a hinge jamb and a strike jamb and a header fitted across the top between the side jambs. Heavier exterior doors may have a temporary strip or permanent sill fastened across the bottom of the jambs. The door and door jambs are prepped for the installation of lock sets, but are not fitted with the knobs, striker plates, latches and such since there are unlimited models and configurations from which a user may choose. The doors are attached to the hinge jamb by hinges and the assembly requires a fastener to hold the door in a "closed" position relative to the door jambs during transport or shipment. If the door is not secured to the door jambs in a closed position, the door jamb is readily damaged. The door is preferably secured tightly to the strike jamb so that no relative movement will occur during shipment. Any movement will of course cause a rubbing action between the door and strike jamb which will likely cause damage to the surface of the door and jamb or at least leave unsightly marks. Current practice is to drive nails through the strike jamb into the edge of the door to securely hold the door during shipping from point of manufacture to point of installation. The nails utilized are typically double headed to facilitate removal.

The use of nails is undesirable. The nails, which will later be removed, leave holes in the edge of the door and face of the strike jamb, which must be filled, sanded and finished. The pre-hung door units are often pre-finished prior to shipment to a user. The prehung door unit is often prefinished by a separate vendor. The vendor must remove the nails in order to finish all sides of the door and door jambs. When the finishing operation is completed, the door is once again secured to the door jambs by driving in another set of nails. This requires that the newly created nail holes also must be filled and finished at the site of the door installation. Additionally, the nails driven in through the strike jamb may on occasion cause splitting of the door jamb or edge of the door. The double headed nails protrude from the surface of the backside of the door jambs and may cause damage to adjacent doors or casings during shipment. Avoiding the use of such fasteners is therefor an object of the present invention.

The present invention utilizes the door prep for accommodating a specially designed fastener that doesn't deface the door and door jamb. The door prep referred to includes a standard face bore and edge bore in the door for mounting lock sets, i.e., a door knob assembly. The strike jamb prep of the door jamb includes a bore for receiving the latch of the lock assembly. The face bore (see FIG. 1, item 30 of drawings) of the door has been standardized at $2\frac{1}{8}$ inch diameter and is backset from the edge of the door a distance of either $2\frac{3}{8}$ inches or $2\frac{3}{4}$ inches. The backset is measured from the edge of the door to the center of the face bore. The edge bore (see FIG. 1, item 32 of drawings) has been standardized at one inch diameter and extends from the edge of the door to the face bore. The bore in the strike jamb (see FIG. 1, item 34 of drawings) is provided as either a one inch diameter circular bore or a rectangular $\frac{3}{4}$ by 1 inch bore. There are variations to the above, but they are considered special and account for a very small percentage of the doors that are pre-hung.

Retainers utilizing the door prep have been developed as demonstrated by U.S. Pat. No. 319,007. The illustrated retainer includes a plug and bolt fastener. The plug is insertable into the edge bore of the door via the face bore. The plug is substantially cylindrical having a diameter to fit snugly in the edge bore of the door. One end of the plug is reduced or flattened in width for a short distance so that it will fit into either the circular or the rectangular bore of the strike jamb. The opposite end of the plug has extended curved ears that will engage the arc surface of the face bore inside the door to limit the plugs entry into the edge bore of the door. A washer head type threaded fastener is inserted through the back side of the bore in the strike jamb and threadably engages the plug to secure the door to the strike jamb.

The described retainer has a number of deficiencies. It is preferable to have the plug of sufficient length to extend into the bore in the strike jamb. It has been found that the barrel length of this prior plug design, of necessity, must be limited in order to insert the plug into the edge bore of the door via the face bore. The barrel length must be short enough so that the plug will "go around the corner" as it is inserted. The extending ears, which conform to the arc of the face bore, limits the overall length of the plug since they must clear the edge of the face bore at the door's surface as the plug is inserted. The limited length does not permit the end of the plug to extend into the bore of the jamb when the cross bore is backset $2\frac{3}{4}$ inches. It is, therefore, desirable to have a plug of sufficient length to extend into the bore of the strike jamb to make a rigid interconnection between the door and the strike jamb for either $2\frac{3}{8}$ or $2\frac{3}{4}$ inches backset dimension.

Convenience of assembly is another factor. Extra seconds required to maneuver the plug into and out of the edge bore is to be avoided. The prior device was so tightly dimensioned that an assembler often had such difficulty. Also, the threaded fastener required additional seconds to screw on and screw off of the plug.

BRIEF SUMMARY OF THE INVENTION

The preferred embodiment of the present invention is a retainer that is similar to the retainer described above (including a plug and bolt fastener), but with modifications that substantially overcome the deficiencies. The plug has one end that defines an open ended threaded bore, and laterally extended lobes that form a straight retaining bar across the other end, i.e., the lobes are small in height (smaller than the plug diameter) and large in width (larger than the plug diameter). The cross section of the plug along the major portion of the length is a segmented circle having opposed flattened sides extended along each of the sides from which the lobes extend. The flattened sides are interrupted at a point near the lobed end of the cylinder by a narrow cinch ring that is simply a segment wherein the cross section is a full circle. The bolt fastener and plug bore have blunt end double lead screw threads to facilitate engagement.

The relationship of the flattened sides and the lobed extensions on the cylindrical plug allows increased barrel length and also easier insertion of the plug into the edge bore. The blunt end double lead screw threads cut assembly time by 50 percent.

The bolt secures the plug in position and may be tightened rapidly to clamp the strike jamb against the edge of the door. The plug, with increased length, is also an aid for the installer of the door. The plug is slidably moveable in the edge bore of the door with the bolt removed. Thus, the installer may utilize the plug as a temporary latch to maintain the door in the closed position as required as the installer sets the door and door jamb assembly in the rough opening. The plug is accessible from either side of the door permitting the door to be latched or unlatched as required as the installer sets the reveal and plumbs the door unit assembly.

Refer now to the drawings and the detailed description for a full understanding of the invention.

BRIEF DESCRIPTION OF THE DRAWINGS

FIG. 1 is a view of a door pre-hung in a door jamb;

FIG. 2 is a perspective view of a door plug and bolt of the present invention;

DETAILED DESCRIPTION OF THE PREFERRED EMBODIMENT

Figure 3:
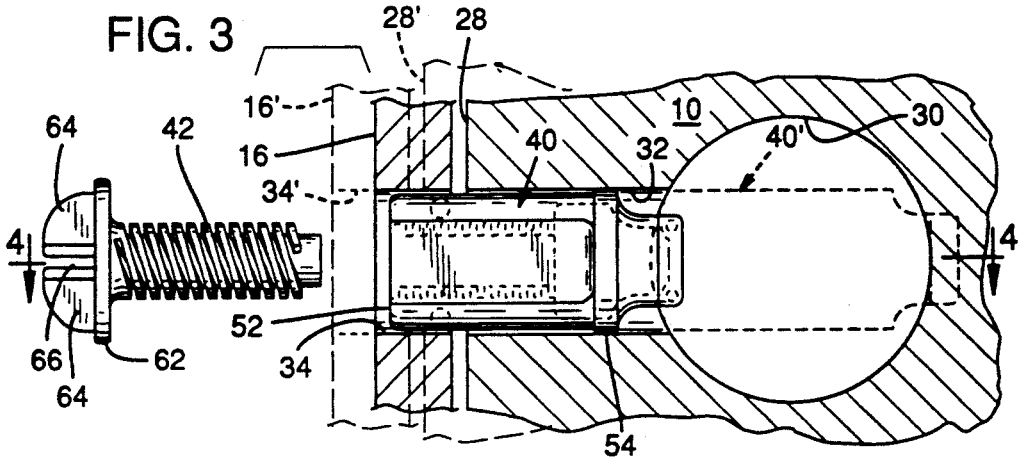
FIG. 3 is a partial view of the door of FIG. 1 taken on section lines 3—3 thereof, showing the installation arrangement of the plug with respect to different backsets of the face bore.

Refer now to FIG. 1 of the drawings which illustrates an assembly of a door jamb 8 and a door 10 with the door 10 shown in a partially open position. The door jamb 8 has two vertical jambs including a hinge jamb 12 and a striker jamb 16. A header 18 interconnects the top of the jambs 12 and 16. The door 10 is mounted to the hinge jamb 12 by hinges 14, the hinges being set in the edge of the door 10 and the hinge jamb 12 in a conventional manner. Also illustrated is an optional temporary bottom spacer 20 or sill extended across the bottom of the jambs 12 and 16 which is generally utilized on heavier exterior doors 10. Conventional door stop moldings 22, 24, 26 are fitted to the inside surface of the door jamb 8 as shown. This may also be a rabbitted door frame as used on exterior door units.

The door 10 and jamb 16 are prepared or prepped for mounting a conventional door knob and lock assembly, the door 10 having a face bore 30 extending through the thickness of the door and an edge bore 32 extending from the edge 28 of the door 10 into the face bore 30. The striker jamb 16 has a bore 34 strategically positioned to be aligned with the edge bore 32 of the door 10 when the door 10 is in a closed position with reference to the door jamb 8.

FIG. 2 illustrates a retainer including a door plug 40 and retaining fastener 42, such as a bolt, utilized to retain the door in a closed position relative to the door jamb 8 to facilitate moving and transporting the door and door jamb assembly. The door 10 is secured to the door jamb 8 to prevent damage to the joints between the jambs 12, 16 and the header 18 of the door jamb 8. As shown in FIG. 4B, the plug 40 is installed in the edge bore 32 of the door 10 and extends into the strike bore 34 of the jamb 16 and acts as a temporary latch to secure the door in the closed position. The bolt 42 secures the plug 40 in position in the edge bore 32 and may be tightened to clamp the strike jamb securely to the edge 28 of the door 10 to prevent any relative movement between the door 10 and door jamb 8.

Figure 5:
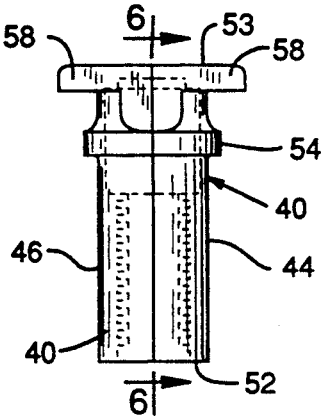
FIG. 5 is a side view of the plug of FIG. 2.
Figure 6:
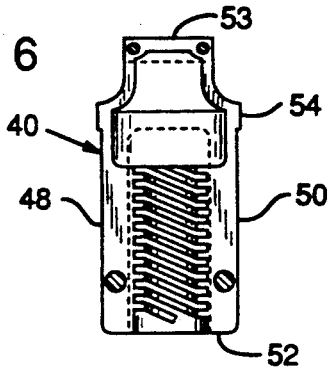
FIG. 6 is a view taken on view lines 6—6 of FIG. 5.

The plug 40 illustrated in FIGS. 2, 5 and 6 is a shaped modified cylindrical member preferably molded of a light weight non-marring material such as plastic. The plug 40 as shown has parallel chordal sides 44, 46 each connecting with opposed arcuate sides 48, 50. The arcuate sides 48, 50 have a common center axis, i.e., the axis of the cylindrical plug 40, and have a radius corresponding closely to the radius of the edge bore 32 of the door 10. The distance between the parallel sides 44, 46 correspond closely to the width of the rectangular bore 34 in the jamb 16 of the door jamb 8. The sides 44, 46 extend from the end 52 to the cinch ring 54 which is formed near end 53. As shown, the cinch ring 54 is concentric to the sides 48, 50 and has a larger radius than the actuate sides 48, 50. Lobes 58 extend from the end 53 of the plug 40 transverse to the longitudinal axis of the plug 40 and are positioned normal to the plane of the surface of the sides 44, 46. A threaded center bore 60 is provided in the end 52 of the plug 40 for receiving a bolt 42.

The bolt 42 as shown in FIG. 2 has a large diameter head 62 that exceeds the major dimension of the bore 34 in the jamb 16. The head is formed with upstanding Tee shaped ribs 64 spaced at a distance from each other as shown to provide a convenient slot 66 for application of a driving tool such as a screw driver or the like. The ribs 64 are sufficiently large for manual manipulation of the bolt which aids in inserting and rotating the bolt 42 as required. It is preferable to have the bore 60 of the plug 40 and the bolt 42 threaded with mating double lead blunt end threads to facilitate rapid insertion and removal of the bolt 42.

As previously mentioned, current industry standards have established the backset of the face bore 30 of the door 10 at either 2⅜ inch or 2¾ inch. The backset is measured from the edge 28 of the door to the center of the face bore 30. FIG. 3 illustrates both situations, the 2⅜ inch backset shown with the door edge 28 and striker jamb 16 in solid lines and the 2⅜ inch backset shown with the door edge 28' and the striker jamb 16' shown in dashed lines. The bore 34, (34') in the striker jamb 16, (16') is illustrated as a rectangular bore. The distance between the sides 44, 46 of the plug 40 correspond closely to the width of the bore 34 and the diameter of the plug defined by the arcuate sides 48, 50 correspond closely to the major length of the bore 34. It is recognized that the bore 34 is often a round bore of the same dimension as the edge bore 32 in the door 10. The diameter of the plug 40 defined by the arcuate sides 48, 50 will fit snugly in such a circular bore 34.

Figure 4A:
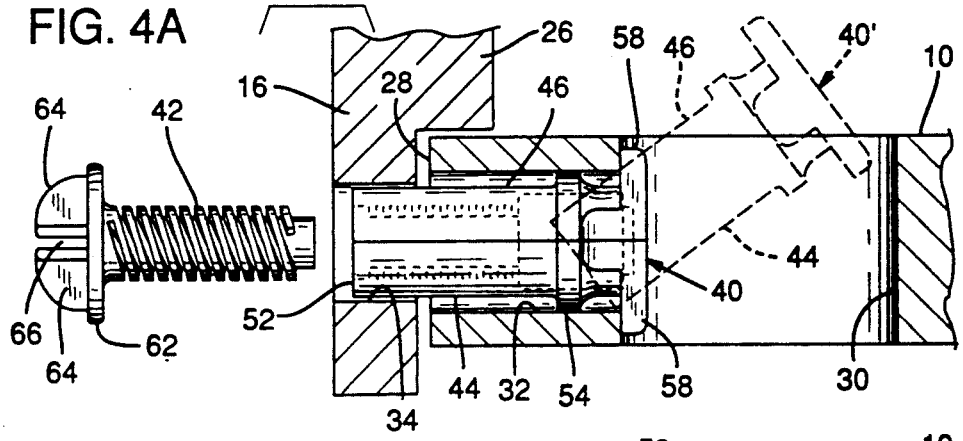
FIGS. 4A and 4B are views showing the installation of the plug as taken on sections lines 4—4 of FIG. 3.
Figure 4B:
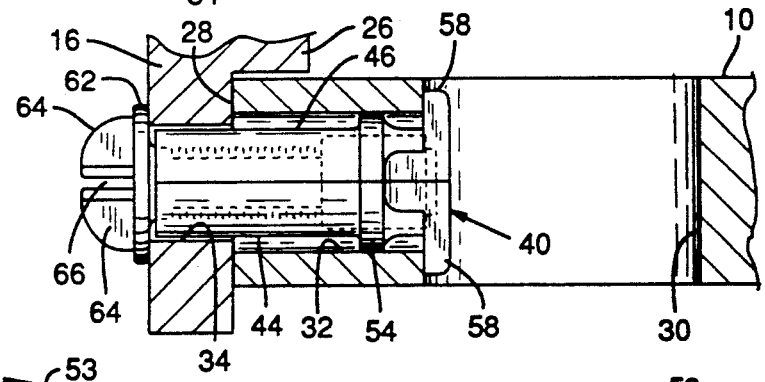

Refer now to FIG. 4A of the drawings. The plug 40 is inserted into the edge bore 32 of the door 10 through the passage afforded by the face bore 30. As indicated by the dashed outline 40', the overall length of the plug 40 is limited so that the plug 40 may be pivoted into alignment with the bore 32 as the plug is inserted into the face bore 30. The plug 40 is inserted initially at an angle to the bore 32 with the end 52 of the plug entering a short distance into the bore 32. The chordal sides 44, 46 provide clearance for this entry and the plug is then pivoted into alignment with the edge bore 32. The lobes 58 preferably clear the arcuate edge of the bore 30 (the arc portion of the bore 30 furthest from the edge 28 of the door 10) as the plug 40 is pivoted into alignment with the edge bore 30. The plug 40 must be short enough to permit the pivotal movement required to enter the edge bore 32. The length of the plug 40 on the other hand must be of sufficient length to extend beyond the edge 28 of the door when installed so it may be received in the strike bore 34 of the jamb 16. The transverse placement of the lobes 58 normal to the plane of the chordal sides 44, 46 permits maximizing the length of the plug 40 extending from the lobes 58 to the end 52.

The plug 40 is inserted into the edge bore 32 with the lobes 58 of the plug 40 parallel to the longitudinal axis of the face bore 30 and in engagement with the surface of the bore 30 adjacent the edge bore 32. The end 52 of the plug 40 extends beyond the edge 28 of the door 10 and into the bore 34 in the strike jamb 16 of the door frame 8.

The bolt 42 is threadably installed in the bore 60 of the plug 40 as illustrated in FIG. 4B with the head 62 engaging the surface of the jamb 16 surrounding the bore 34. The plug interfitting in the edge bore of the door 10 and the bore 34 of the jamb 16 provides a latch which secures the door 10 in a closed position relative to the door jamb 8. The bolt 42 may be tightened sufficiently to draw the jamb 16 into contact with the edge 28 of the door 10 to thus fixedly secure the door 10 to the door jamb 8.

The sides 44, 46 extending the major length of the plug 40, i.e. from end 52 to the cylindrical portion 54, and the cylindrical diameter defined by the actuate side 48, 50 permits easier insertion and removal of the plug 40. The relief provided by the sides 44, 46 and 48, 50 reduces the contact area between the edge bore 32 and the plug 40 which enables ease of movement of the plug 40 within the edge bore 32. This in addition to the initial installation of the plug 40 is an aid to an installer setting the door and door jamb assembly in a door opening. The installer, upon removal of the bolt 42, is able to easily move the plug 40 (in the bore 32) into and out of engagement with the bore 34 in the strike jamb 16. The plug 40 is thus a temporary latch mechanism for the installer. The cinch ring 54 which is dimensionally close to the diameter of the edge bore 32 restricts lateral movement of the plug 40 in the bore 32 after the plug is fully seated in bore 32.

Those skilled in the art will recognize that modifications and variations may be made without departing from the true spirit and scope of the invention. The invention is therefore not to be limited to the embodiments described and illustrated but is to be determined by the appended claims.

What is claimed is:

1. A retainer for a door and door jamb assembly wherein the door is pre-hung on the door jamb by hinges, and the door and a strike jamb of the door jamb are prepped for receiving a lockset whereby a cylindrical face bore extends through the door and a cylindrical edge bore extends from said face bore to a door edge and a bore is formed in said strike jamb of the door jamb, the retainer comprising;

a plug having a periphery that is partially cylindrical to form a cylindrical portion of said periphery and having a threaded center bore, and the cylindrical portion of said periphery dimensioned to closely fit the cylindrical edge bore of said door, lobes extending transversely at one end of said plug and outwardly therefrom at opposed positions relative to the periphery of said plug and forming thereby a cross bar that is smaller in height and greater in width than the plug for limiting entry of said plug into the edge bore, and an opposite end of said plug extending beyond the edge of said door when said plug is inserted in said edge bore from said face bore, said opposite end engageable with the bore in the strike jamb to latch said door in a closed position relative to said door jamb, a threaded fastener insertable through strike bore and threadably engageable with the threaded bore of said plug with the plug inserted in the edge bore of the door to thereby retain said plug and to secure said door in a closed position relative to said door jamb, and said plug configured with opposed flat sides extended from said opposite end of the plug and at least partially along the length thereof, said flat sides positioned on the periphery of said plug in alignment with the lobes and defining thereby a relieved crossway dimension of said plug to facilitate entry of the plug in the face bore of the door.

2. A retainer as defined in claim 1 wherein the lobes are straight sided with an overall length no greater than the door thickness and designed to reside crossway relative to the plane of the door.

3. A retainer as defined in claim 2 to fit prepped doors having different face bore set back settings, said plugs having an overall length that is maximized as permitted by the cylindrical face bore to protrude into the strike jamb bore at said different set back settings.

4. A retainer for a door and door jamb assembly wherein the door is pre-hung on the door jamb by hinges, and the door and a strike jamb of the door jamb are prepped for receiving a lockset whereby a cylindrical face bore extends through the door and a cylindrical edge bore extends from said face bore to a door edge and a bore is formed in said strike jamb of the door jamb, the retainer comprising;

a plug having a periphery that is partially cylindrical to form a cylindrical portion of said periphery and having a threaded center bore, and the cylindrical portion of said periphery dimensioned to closely fit the cylindrical edge bore of said door, lobes extending transversely at one end of said plug and outwardly therefrom at opposite sides of said plug and forming thereby a cross bar for limiting entry of said plug into the edge bore, and an opposite end of said plug extending beyond the edge of said door when said plug is inserted in said edge bore from said face bore, said opposite end engageable with the bore in the strike jamb to latch said door in a closed position relative to said door jamb, a threaded fastener insertable through strike bore and threadably engageable with the threaded bore of said plug with the plug inserted in the edge bore of the door to thereby retain said plug and to secure said door in a closed position relative to said door jamb, said plug configured with opposed flat sides extended along opposed sides of the plug and defining thereby a relieved crossway dimension of said plug to facilitate entry of the plug in the face bore of the door, and a short lengthwise section of the plug adjacent said lobed end provided with a full circular cross section substantially the same dimension as said edge bore that seats inside said edge bore of the door to provide a cinch ring with the plug inserted in the edge bore.

5. A retainer as defined in claim 4 wherein said cylindrical periphery has a radius less than said cinch ring.

6. A retainer as defined in claim 5 wherein the center bore and threaded fastener have mated double lead screw threads for rapid engagement and fastening of the retainer.

7. A retainer as defined in claim 6 wherein the threads in the center bore and on the fastener are blunt end threads.

8. A retainer as defined in claim 7 wherein upstanding tee shaped ribs formed on the fastener head provide for manual gripping and a slot formed between said ribs provide for engagement of a driving tool.

9. A retainer as defined in claim 4 wherein said opposed flat sides are extended along the sides defined by said lobes.

* * * * *

US005159782C1

(12) EX PARTE REEXAMINATION CERTIFICATE (5853rd)

United States Patent

Sales

(10) Number: US 5,159,782 C1

(45) Certificate Issued: Aug. 14, 2007

(54) RETAINER FOR PRE-HUNG DOOR

(76) Inventor: Charles R. Sales, 4243 Springrock Cir., West Linn, OR (US) 97068

Reexamination Request:
No. 90/007,494, Apr. 4, 2005

Reexamination Certificate for:

| | |
|---|---|
| Patent No.: | **5,159,782** |
| Issued: | **Nov. 3, 1992** |
| Appl. No.: | **07/820,340** |
| Filed: | **Jan. 14, 1992** |

(51) Int. Cl.
*E06B 1/00* (2006.01)

(52) U.S. Cl. ..... 49/380; 206/325; D8/382

(58) Field of Classification Search ..... None
See application file for complete search history.

(56) References Cited

U.S. PATENT DOCUMENTS

| | | | |
|---|---|---|---|
| 121,060 | A | 11/1871 | Mutimer |
| 939,004 | A | 11/1909 | Gill |
| 1,988,925 | A | 1/1935 | Thomson |
| 2,720,308 | A | 10/1952 | Howell, Jr. |
| 2,706,837 | A | 4/1955 | Jackson |
| 2,728,956 | A | 1/1956 | Jackson |
| 2,730,773 | A | 1/1956 | Logue |
| 2,927,352 | A | 3/1960 | Chenoweth |
| 3,584,416 | A | 6/1971 | Baumgartel |
| 3,593,458 | A | 7/1971 | Wahlfeld |
| 4,001,972 | A | 1/1977 | Hurwitz |
| 4,151,681 | A | 5/1979 | Roberts |
| 4,483,101 | A | 11/1984 | Berzina |
| 4,718,195 | A | 1/1988 | Ortega |
| 4,739,561 | A | 4/1988 | Mills |
| 4,854,618 | A | 8/1989 | Webster |
| 4,876,866 | A | 10/1989 | Fleming et al. |
| 4,884,687 | A | 12/1989 | Steves |
| D319,007 | S | 8/1991 | Rogers et al. |
| 5,209,017 | A | 5/1993 | Ridge |

FOREIGN PATENT DOCUMENTS

DE 27 18 562 A1 11/1978

*Primary Examiner*—Matthew C. Graham

(57) ABSTRACT

A retainer for securing and retaining a pre-hung door unit in a closed position relative to a door jamb. The retainer includes a shaped cylindrical plug configured to fit closely in the edge bore of the door. The plug is insertable into the edge bore through the face bore of the door and has lobes extending transversely to limit its entry into the edge bore. The placement of the transverse lobes maximizes the length of the plug extending from the lobes which enables an end of the plug to extend beyond the door edge into a bore in the strike jamb of the door jamb when the door is closed relative to the door jamb. A bolt extended through the back of the strike jamb and engaging the plug secures the plug in position and secures the door in a closed position relative to the door jamb. The bolt may be tightened adequately to clamp the strike jamb to the door edge. The bolt and the plug are provided with double lead blunt end threads for rapid assembly and disassembly. The plug has relieved sides for ease of moving the plug within the edge bore of the door which is a benefit for installing the plug and also is an aid to a door installer. A cinch ring provided on the plug near the extended lobes prevents lateral movement of the plug in the edge bore. The configuration of the plug accommodates both circular and rectangular bores that are normally provided in the strike jamb of the door jamb.

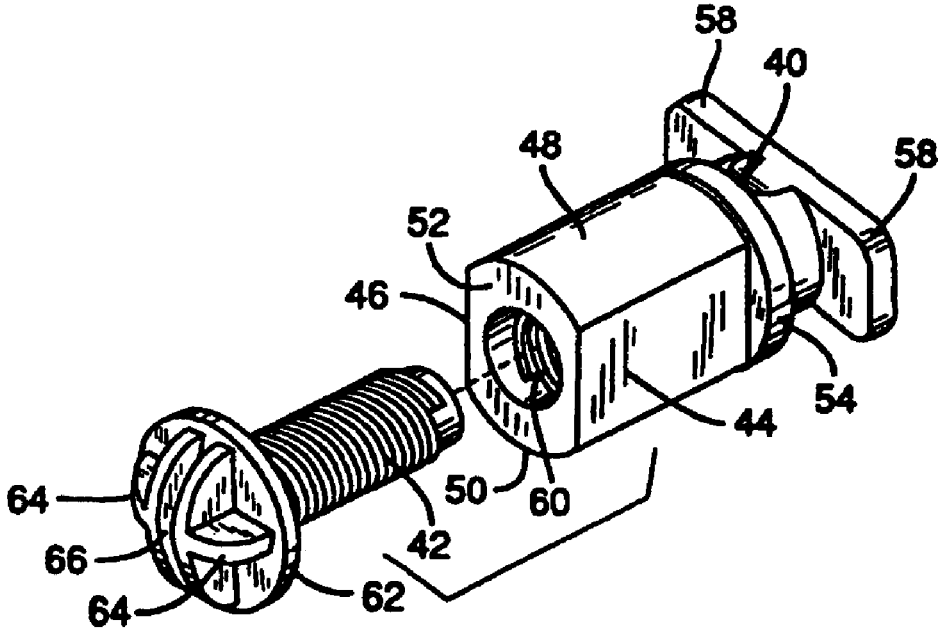

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–3 and 5–9 is confirmed.

Claim 4 is cancelled.

New claims 10 and 11 are added and determined to be patentable.

*10. A retainer as defined in claim 9, wherein said cylindrical periphery has a radius less than said cinch ring.*

*11. A retainer as defined in claim 9, wherein said cross bar is smaller in height and greater in width than the plug.*

* * * * *